US005493292A

United States Patent [19]

Fanslow et al.

[11] Patent Number: 5,493,292

[45] Date of Patent: Feb. 20, 1996

[54] TRAFFIC CONTROL SYSTEM FOR CONSTRUCTION ZONES AND THE LIKE

[76] Inventors: Bentley M. Fanslow; Charles E. Fanslow, both of R.R. 3, Box 110, Red Wing, Minn. 55066

[21] Appl. No.: 311,677

[22] Filed: Sep. 23, 1994

[51] Int. Cl.[6] ..... G08G 1/095

[52] U.S. Cl. ..... 340/908; 40/435; 40/612; 340/907

[58] Field of Search ..... 340/907, 908, 340/908.1, 472, 473, 480, 484, 481–483, 486–487; 116/46, 63 R, 63 P, 284, 298, 309, 314, 315; 40/430, 433, 435, 473, 474, 489, 490, 534, 612

[56] References Cited

U.S. PATENT DOCUMENTS

| | | | |
|---|---|---|---|
| 2,443,631 | 6/1948 | McDermott et al. | 40/430 |
| 3,315,389 | 4/1967 | Drueck, Jr. | 40/435 |
| 3,323,242 | 6/1967 | Schoenung | 40/435 |
| 3,886,519 | 5/1975 | Hovland | 340/908.1 |
| 4,922,223 | 5/1990 | Prevot | 340/908 |
| 5,001,475 | 3/1991 | Scovin | 340/908 |

*Primary Examiner*—Brent A. Swarthout
*Attorney, Agent, or Firm*—John W. Adams

[57] ABSTRACT

A traffic control signal particularly adapted for alternate one-way traffic situations such as are frequently encountered in highway construction zones whereby 'STOP' AND "SLOW" sign panels can be alternately displayed with suitable control mechanism which produces a combination rotational and axial displacement of a signal panel whereby one traffic control message can be superimposed upon another for displaying either a "STOP" message or a "SLOW" for the vehicular traffic.

4 Claims, 5 Drawing Sheets

TRAFFIC CONTROL SYSTEM FOR CONSTRUCTION ZONES AND THE LIKE

BACKGROUND OF THE INVENTION

It is frequently necessary to provide a traffic control system, particularly through a highway construction zone, but also in conjunction with alternate one-way traffic control such as is necessary with narrow bridge and road areas. In most instances, construction zones are controlled by providing two flag persons, one at each end of the section of the one-way section being controlled, so that vehicles traveling in one direction will be stopped while the vehicles going in the other direction will be permitted to pass through the one-way section.

The present invention is designed to eliminate the need for individual control persons by providing a timed octagonal sign assembly which includes a rotating panel unit and a stationary panel unit.

SUMMARY OF THE INVENTION

The present invention provides two sign segments which can be readily actuated for controlling the flow of traffic through a restricted alternate one-way traffic section such as is frequently required in construction zones. In the form of the invention disclosed and claimed herein, two separate sign panel units are provided and they are adapted to be mounted for display at each end of the construction zone. One of the segments constitutes a rotatable panel with one traffic control message displayed thereon and the other is a stationary sign panel which has another traffic control message displayed thereon. One of the panels is rotatable into and out of a visible superimposed display position in front of the other panel. This is accomplished by providing a pair of helical panel units each having a radially disposed by-pass slot which permits one of the panels to be rotated into and out of superimposed display position in front of the other sign panel. This is accomplished by means of a rotatable shaft fixed to one of the panels for rotating the same and also providing a thrust gear mechanism which produces axial displacement during rotation of the rotatable shaft and the panel fixed thereto to permit the rotatable panel to rotate through the slot of the stationary panel into a retracted hidden position behind the stationary panel whereby the message on the stationary panel is displayed and the message on the rotatable panel is concealed from view.

In the form shown the "STOP" message is displayed on the stationary panel and the "SLOW" message is displayed on the rotatable panel. A fixed guide channel is provided for stabilizing the rotating panel during its rotational cycle into and out of display position. The entire unit is shown mounted on a suitable trailer unit for transporting the same from one location to another and of course in any one-way traffic control situation, two units would be required to be placed respectively at each end of the one-way traffic situation.

DETAILED DESCRIPTION OF THE DRAWINGS

DETAILED DESCRIPTION OF THE PREFERRED EMBODIMENT

Figure 1:
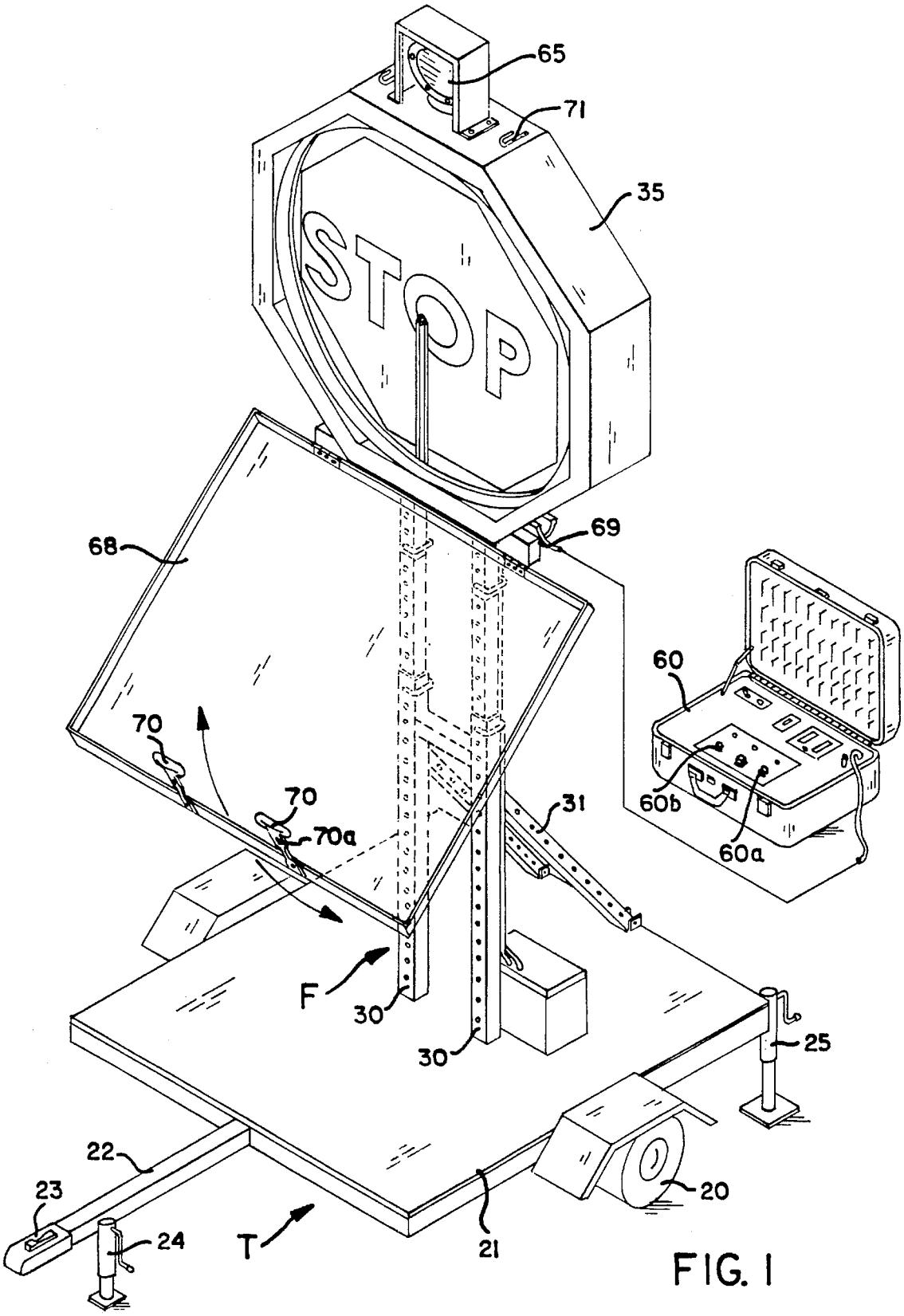
FIG. 1 is a front perspective view of a sign embodying this invention and mounted on a wheeled trailer assembly.
Figure 2:
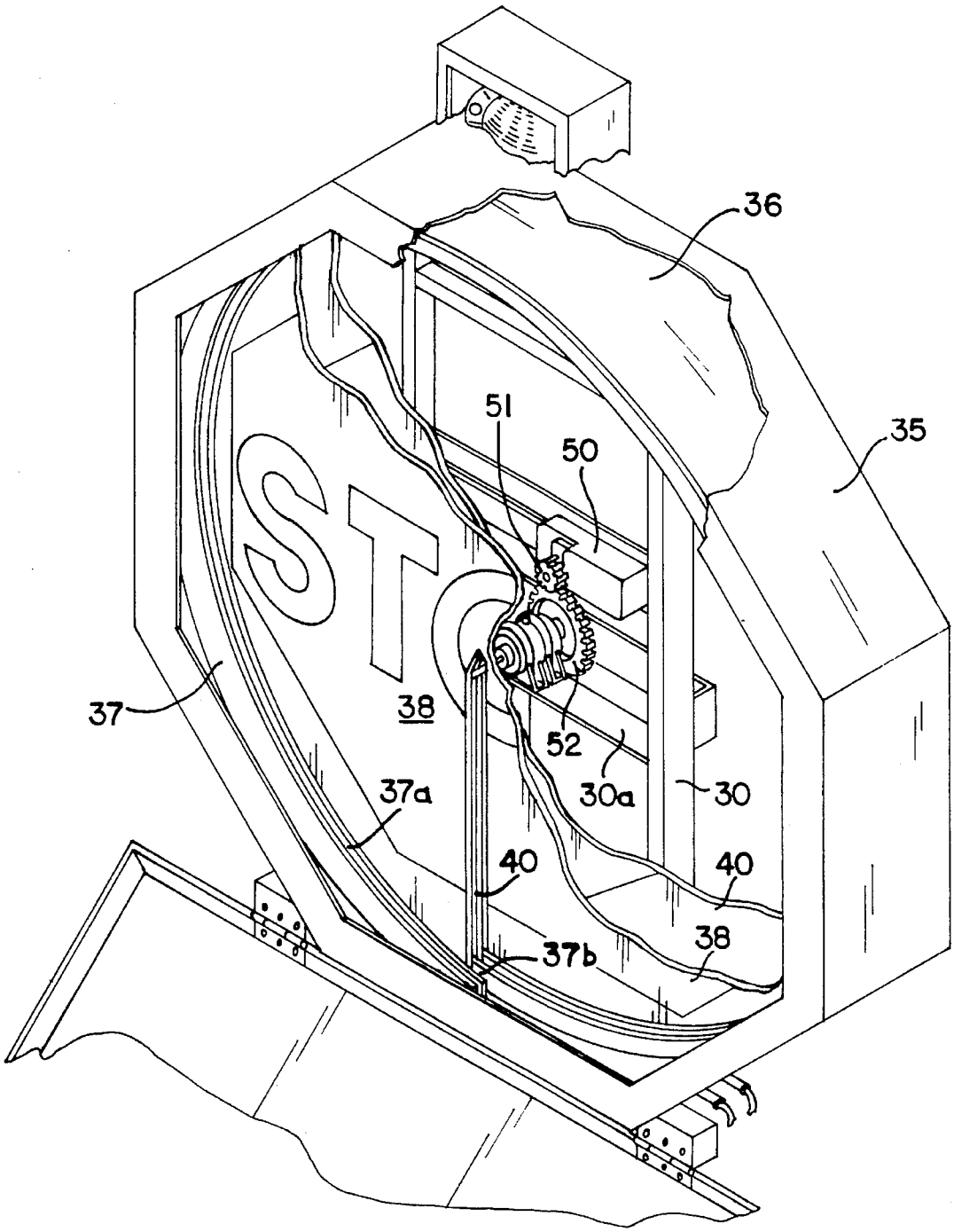
FIG. 2 is a perspective view of a portion of the sign actuating mechanism with portions broken away.
Figure 3:
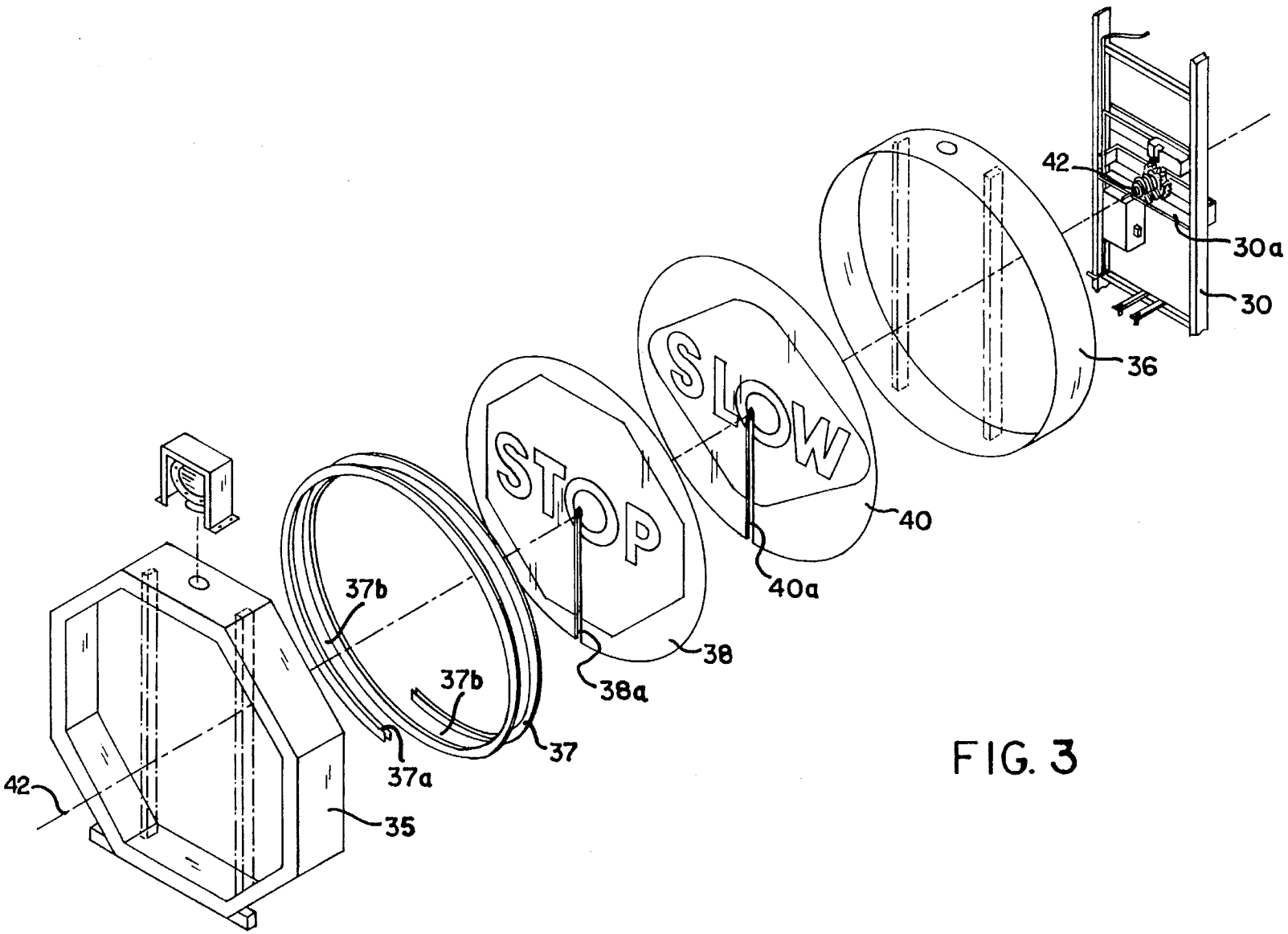
FIG. 3 is an exploded perspective view showing the individual parts of the sign mechanism.

FIG. 1 illustrates a control sign embodying this invention. A portable mounting for the sign illustrated constitutes a trailer T having suitable wheels 20, a platform 21, a draw bar 22 and a trailer hitch 23. A suitable stand 24 is provided on the draw bar 22 with stabilizing jacks 25 at the rear corners of the trailer platform 21. A sign-supporting frame F is mounted on the platform 21 and includes an adjustable upright frame structure 30. A pair of diagonal struts 31 are connected to intermediate portions of the adjustable upright frame structure 30 to securely hold the frame 30 in upright position on the trailer. The bottom of the structure 30 is pivoted on the platform 21 to permit the same to be collapsed for compact storage and transportation, The diagonal struts 31 are removably connected to said posts to facilitate the compact folding of the unit.

The sign mechanism is mounted in a octagonal housing 35 carried by the frame 30 and has a cylindrical housing 36 fixed within the octagonal housing 35. A spiral guide channel 37 is fixed within the cylindrical housing 36. A stationary helical display panel 38 having a radial bypass slot **38*a* is fixed within the cylindrical housing 36 and is positioned in the space provided between the convolutions of the channel 37**.

Figure 4:
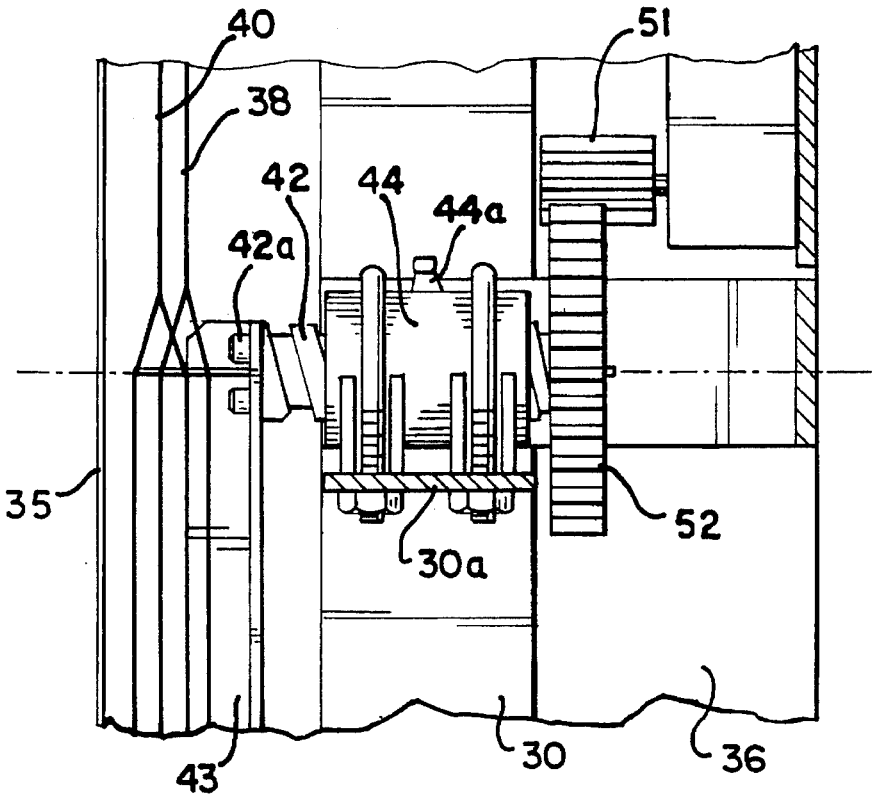
FIG. 4 is a perspective view showing the power actuated sign changing mechanism in "slow" position.
Figure 5:
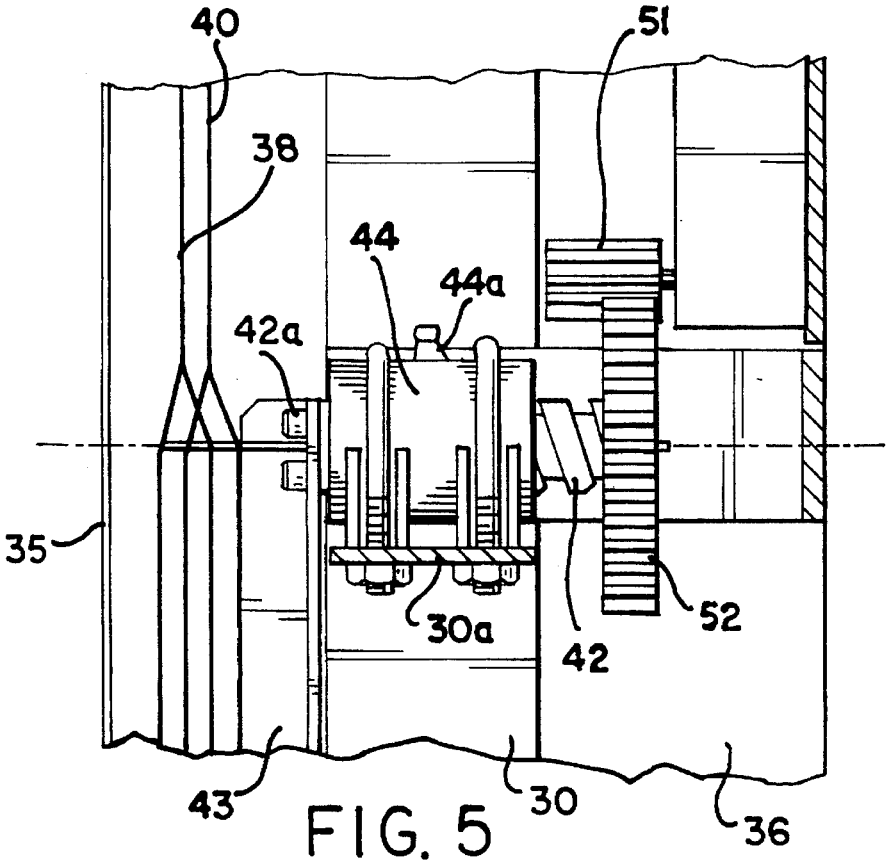
FIG. 5 is similar to FIG. 4 but shows the mechanism in "stop" position; and, FIG. 6 is a block wiring diagram showing the electrical control mechanism.
Figure 6:
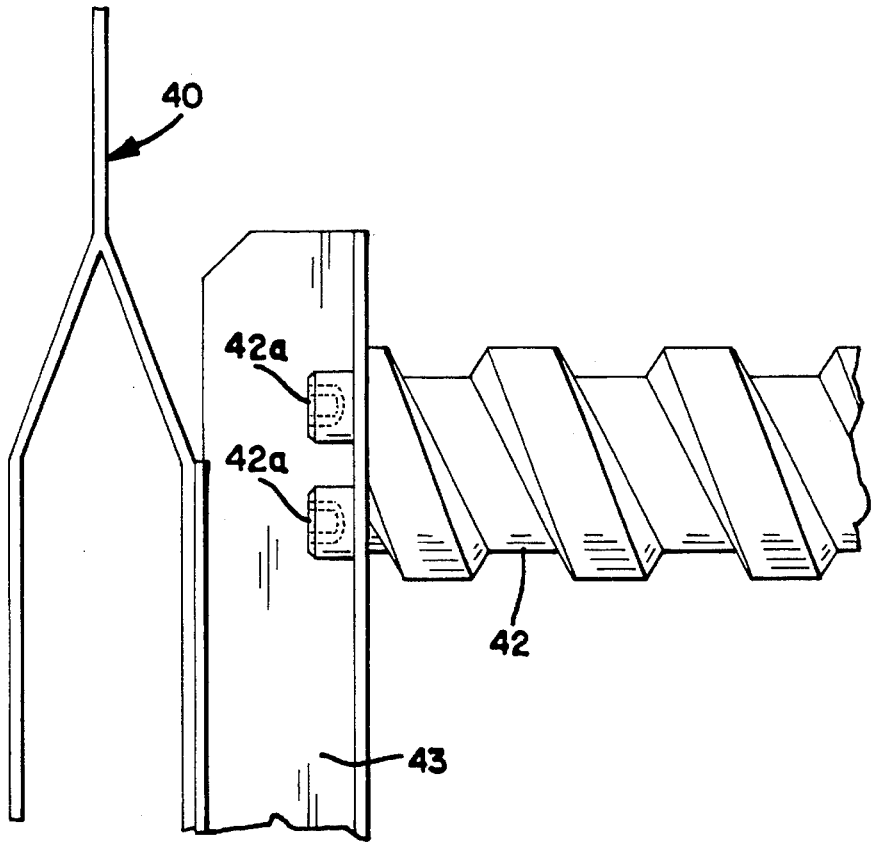

A rotary helical panel 40 having a similar pitch to the pitch of the stationary display panel 38 is mounted for rotation in the fixed helical guide channel 37. A radial slot **38*a* in the panel 38 provides a radially extending by-pass opening through which the rotary panel 40 is free to pass. The outer peripheral edge of the helical panel 40 travels in the groove 37*a* of the guide channel 37. The stationary panel 38 is received in a groove 37*b* formed between spaced adjacent sections of the spiral channel 37. The channel 37 provides two 360 degree convolutions within which the rotatable panel 40 travels and the thickness of the side wall portions of the channel track maintains the desired spacing between the two panels 38 and 40. The rotatable panel 40 is fixed to a main spiral drive shaft 42 as by a bracket 43 which is bolted to the end of the drive shaft 42 as by bolts 42*a* and is welded to the back side of the rotary panel 40, as best shown in FIGS. 4, 5 and 6. The spiral shaft 42 meshes with a stationary worm gear 44 which is securely anchored to a cross frame member 30*a* of the metal frame 30 of the unit. A worm gear 44 is provided with a suitable grease fitting 44*a***.

An electric motor 50 is connected to the worm gear 42 by the meshed gears 51 and 52. The gear 52 is fixed to the shaft 42 and moves axially therewith and the axial length of the gear 52 is sufficient to accommodate the axial movement of the shaft back and forth as it rotates while maintaining its driving connection with the small driving gear 51 which is driven by the motor 50. It will be apparent that rotation driving gear 51 by the motor 50 will cause rotation of the gear 52 fixed to the thrust shaft 42 and produces the desired axial displacement of the helical sign panel 40.

A suitable electrical switching unit is provided within the casing 60 with control buttons 60*a* and 60*b* for controlling the direction of rotation of the electric motor 50. A signal light 65 may be mounted on the top of the octagonal housing 35 to identify the traffic control signal and provide a warning to the motorists. A suitable cover panel 68 is hinged at the bottom of the octagonal housing 35 to a cross frame member 69 and anchoring straps 70 made from suitable resilient material permit the insertion of the hooks 71 through cooperating holes 70*a* formed in the straps 70.

DESCRIPTION OF ELECTRICAL CIRCUITRY

The invention herein is directed to the mechanical construction described above wherein one of the sign panels 40 is rotatable relative to the stationary panel 38 by the motor 50 via the gears 51, the shaft 42, and the spiral guide channel 37. The radial bypass slots 38*a* and 40*a* in the panels 38 and 40 facilitate the rotary movement of the moveable panel 40 from a visible position in front of the stationary panel 38 to a non-visible position behind the stationary panel 38, and vice versa.

The simple rotary movement of the panel 40 in opposite directions is effected by selectively causing the motor 50 to rotate in one direction or the other. As an alternative the motor may have only unidirectional movement and appropriate gearing could be provided to effect rotation of the panel 40 opposite directions.

Figure 7:
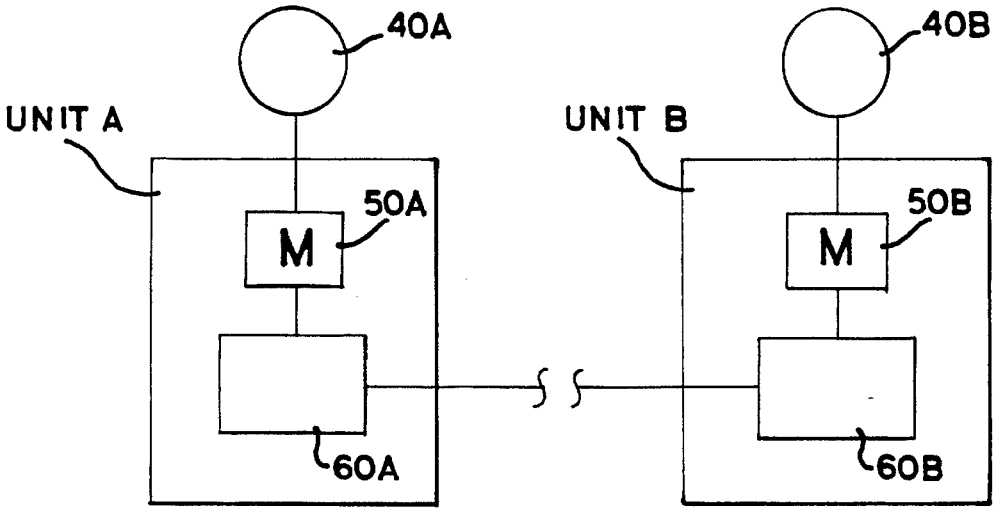
FIG. 7 shows the use of the two traffic control units.

A traffic control system would require the use of two traffic control units A and B as shown in FIG. 7. Units A and B would be of the type disclosed in FIGS. 1 to 4 and would operate in combination or tandem at the respective opposite ends of a segment of roadway upon which traffic is to be controlled.

A traffic control system would comprise two units A and B and would include a pair of electrical switching control means 60A and 60B which have initial "at rest" or idle stages in which the respective motors 50A and 50B of units A and B are set so that the stationary panels 38 of both units display the "STOP" message to traffic approaching the controlled segment of roadway from both directions.

The control means 60A and 60B would have transmitting and receiving capabilities which would provide communication between the units A and B. This could be by wire or by wireless.

The control means 60A and 60B associated with each of the Units A and B could be similar or identical in construction.

Each of the control means 60A and 60B would have means for starting and stopping the respective motors 50A and 50B to effect movement of the connected rotatable panel 40*a* or 40*b* in one direction or the other.

Control means 60A and 60B would preferably comprise integrated circuitry including timing means operable in first and second modes. The first timing mode would provide a desired time interval which allows the clearing of traffic from the road segment after a reversal of direction of traffic flow is initiated. The selected time interval for clearing traffic after the flow in one direction is reversed may be the same or different relative to the reversal in the other direction.

The second timing mode would provide a desired time interval during which vehicles are allowed to travel in one direction on the controlled road segment. The selected time interval for allowed traffic to flow in one direction may be the same as or different than the time interval selected relative to the flow of traffic in the other direction.

In the operation of the units, after a direction of allowed traffic is determined, and assuming initially that the traffic will be from unit A towards unit B, the first step is to start the motor 50A of unit A so that panel 40A thereof is moved to display the "SLOW" message which permits movement of traffic past the A unit.

Changing the direction of traffic after a predetermined desired second mode time interval involves two steps which are:

1) The operation of the motor 50A so that the stationary panel 38 of unit A is interposed in front of the panel 40 and displays the "STOP" message, and
2) The initialization of a first mode time delay interval prior to effecting movement of the motor 50B of unit B to effect the showing by the panel 40 displaying the "SLOW" message thereon to allow the clearing of the flow of traffic from unit A toward unit B prior to directing the flow of traffic in the opposite direction from unit B towards unit A.

When it is desired to again change the direction of the flow of traffic from unit A towards unit B, the above steps 1 and 2 are repeated in a toggling manner with the controls relative to the motors 50A and 50B of units A and B being reversed.

With reference to the first and second time modes referred to above, the time in each case could be set for a desired number of minutes or a variable time could be utilized based on sensing the volume of traffic in both directions.

What is claimed is:

1. A traffic control signal apparatus particularly adapted for use to control traffic through a one-way construction zone, said apparatus comprising a pair of matched flat helical panels having matching radial by-pass slots to produce helical offset radial edges and permit one panel to be rotated into and out of super-imposed position overlying the other, one of said panels being rotatable relative to the other and each panel having a different traffic control message displayed thereon, a rotatable shaft fixed to the rotatable panel and the shaft and panel being mounted for axial displacement, means for rotating the shaft and the panel fixed thereto, an axial thrust gear connected to said shaft and including a helical thrust gear element to project said shaft forward when rotated in one direction and rearward when rotated in another direction and, a control mechanism to control the relative rotational positioning of the panels.

2. The structure set forth in claim 1 and an electric motor having a driving connection with the shaft to rotate the same, and said control mechanism controlling the actuation of the motor.

3. The structure set forth in claim 2 and a timing circuit embodied in the control mechanism for timing the actuation of the motor.

4. Structure set forth in claim 1 and a housing surrounding the two panels, one of the panels being fixed to the housing, a helical guiding track fixed within the housing, and the rotatable panel being rotatable within the housing and traveling in the guiding track.

* * * * *